United States Patent [19]

Albeck et al.

[11] Patent Number: 4,711,019

[45] Date of Patent: Dec. 8, 1987

[54] METHOD OF MAKING CORE LAMINATIONS, AND PUNCH DIE FOR CARRYING OUT THE METHOD

[75] Inventors: Bernhard Albeck, Waiblingen-Neustadt; Siegfried Goedicke, Urbach, both of Fed. Rep. of Germany

[73] Assignee: Schwabe GmbH, Urbach, Fed. Rep. of Germany

[21] Appl. No.: 840,919

[22] Filed: Mar. 18, 1986

[30] Foreign Application Priority Data

Mar. 26, 1985 [DE] Fed. Rep. of Germany ..... 3510854

[51] Int. Cl.[4] ..... H01F 3/04

[52] U.S. Cl. ..... 29/609; 29/415; 83/32

[58] Field of Search ..... 29/609, 415; 83/32, 83/49, 50, 43

[56] References Cited

U.S. PATENT DOCUMENTS

| | | | |
|---|---|---|---|
| 3,181,402 | 5/1965 | Kuck et al. | 29/609 |
| 3,201,731 | 8/1965 | Baenziger et al. | 29/609 |
| 3,456,535 | 7/1969 | Schwennesen | 83/32 |
| 3,491,437 | 1/1970 | Small | 29/609 |
| 3,636,488 | 1/1972 | Wiesner | 336/83 |
| 3,646,493 | 2/1972 | Wiesner | 336/178 |

FOREIGN PATENT DOCUMENTS

| | | |
|---|---|---|
| 294270 | 11/1971 | Austria . |
| 2638780 | 3/1977 | Fed. Rep. of Germany . |
| 2745701 | 4/1978 | Fed. Rep. of Germany . |
| 2652171 | 5/1978 | Fed. Rep. of Germany . |
| 2309727 | 8/1978 | Fed. Rep. of Germany . |
| 2836401 | 2/1980 | Fed. Rep. of Germany . |
| 2070783 | 9/1971 | France . |
| 1328160 | 8/1973 | United Kingdom . |

*Primary Examiner*—P. W. Echols

*Attorney, Agent, or Firm*—Frishauf, Holtz, Goodman & Woodward

[57] ABSTRACT

In a method for making U-shaped core laminations and T-shaped magnetic circuit closing elements fitting in between the legs thereof, in a choke, ballast or transformer, in particular for use as an accessory element in gas discharge lamps, two mutually offset rows of U-shaped core laminations having their open ends facing one another and having the pairs of adjacent outer legs thereof interfitting with one another are punched out in such a manner that one pair of outer legs of one row is laterally adjacent to one pair of outer legs of the other row, and the T-shaped magnetic circuit closing elements, with cross legs adjacent to the connecting middle legs of the U-shaped core lamination are punched out of the free spaces located between the ends of the pairs of outer legs and the connecting legs, located facing tem and spaced apart from them, of the U-shaped core laminations. The T-shaped magnetic circuit closing elements are punched out in such a position that their long, or center, legs on one side are laterally adjacent one pair of outer legs of the respective opposing row of U-shaped core laminations and on the outer side these long or center legs are laterally adjacent the long or center legs of a neighboring, opposed T-shaped magnetic circuit closing element. A punch die suitable for carrying out the method is also proposed.

6 Claims, 3 Drawing Figures

METHOD OF MAKING CORE LAMINATIONS, AND PUNCH DIE FOR CARRYING OUT THE METHOD

REFERENCE TO RELATED PUBLICATIONS

British No. 1,328,160, Zumtobel (to which French No. 70 44 124 publication document No. 2 070 783 corresponds)

Austrian No. 294 270, Berndeisel & Co.

German No. 23 09 727, Schwabe

German Patent Disclosure DE-OS No. 26 38 780, Leuenberger

German Patent Disclosure DE-OS No. 27 45 701, Lilja

The present invention relates to a method of making U-shaped and T-shaped core elements, particularly for ballasts, chokes, or transformers in which the T-shaped core elements form magnetic return or magnetic circuit closing elements, and more particularly to a method and die in which, upon punching from a strip of electrical sheet steel, waste or scrap is essentially avoided.

BACKGROUND

Ballasts, chokes and/or transformers serving as accessory elements for gas discharge lamps, typically fluorescent lamps, and having U-shaped core laminations and T-shaped magnetic return or magnetic circuit closing elements used with their transverse members between the outer members are known (Austrian Pat. No. 29 42 70). They have the advantage that with U-shaped core laminations surrounding the T-shaped magnetic circuit closing element, a mechanically stable structure is obtained, the parts of which can be secured at the abutting areas of the members, or legs, by interfitting engagement devices and/or can be pressed together with a bias; as a result, the required absence of hum can be assured by relatively simple means. The fundamental disadvantage of this U/T punch cutting of the core laminations is that a considerable amount of waste or scrap is produced during punching. Various methods have accordingly been proposed for producing such core laminations with less waste or scrap. In so doing, however, othermore or less important disadvantages have been imposed in return.

For instance, the T-shaped magnetic circuit closing element has been divided into two L-shaped lamina parts, which can be stamped out essentially without waste at the same time as the U-shaped core laminations (German Patent Disclosure DE-OS No. 26 38 780). This provision, however, necessitates handling three separate core elements in assembling the ballast, choke or transformer; this is labor-intensive and undesirable. Furthermore, the mechanical strength of the core as a whole is impaired.

These disadvantages are basically also found in a method (German Patent Disclosure DE-OS No. 27 45 701) in which the U-shaped core laminations are divided into two L-shaped lamina parts, and the T-shaped magnetic circuit closing elements for them are punched out in one piece. This method has still another disadvantage, which is that the L-shaped lamina parts and the T-shaped magnetic circuit closing elements must be punched out using different punches, which makes their manufacture more difficult. The same is basically true of yet another method (German Patent Disclosure No. 23 09 727), in which the disadvantage of a three-part core structure is overcome by producing M-shaped core laminations which are then bent into a U shape; here again, however, the T-shaped magnetic circuit closing elements must be stamped out using a separate tool.

Finally, still another method has been disclosed (British No. 1 328,160, to which French No. 20 70 783 corresponds), over which the present invention is an improvement. In this method, essentially waste-free punching of U-shaped core laminations and T-shaped magnetic circuit closing elements is possible using one tool. However, the T-shaped magnetic circuit closing elements are stamped out of the free spaces laterally defined by the outer legs of the U-shaped magnetic circuit closing elements in such a way that the outer legs of a U-shaped core lamination each laterally define one T-shaped magnetic circuit closing element located with its cross-leg between them. The long leg of this magnetic circuit closing element, in turn, is stamped out of the two outer legs—protruding between the outer legs of one U-shaped core lamination—of two other, opposed U-shaped core laminations; as a result, recesses are necessarily cut into these outer legs, corresponding to the middle leg of the T-shaped magnetic circuit closing element. This decreases the cross section of material on the outer legs of the U-shaped core laminations that is available for the magnetic flux. The width and the length of the middle legs of the T-shaped magnetic circuit closing elements are therefore limited. Also, it is not possible to provide recesses of approximately triangular cross section on the outer sides of the outer legs of the U-shaped core laminations, although such recesses are required for clamping on an approximately U-shaped clamping rail that assures the necessary bias at the sectional planes of the abutting core parts of the ballast, choke or transformer.

THE INVENTION

It is accordingly the object of the invention to devise a method and a punch for essentially waste-free punching of U-shaped core laminations and T-shaped magnetic circuit closing elements fitting between the legs of the U-shaped elements, requiring only one punch and not presenting any limitations in terms of the electromagnetic properties of the ballast, choke or transformer of such a nature that undesirable reductions in the cross section of the magnetic path, or compromises in terms of the length or dimensions of the magnetically functioning core parts, are necessary.

Briefly, in accordance with the invention, the T-shaped magnetic circuit closing elements are punched out with their long legs resting laterally, on one side, on one pair of outer legs of an opposed row of U-shaped core laminations and, on their other side, on the long legs of a neighboring opposed T-shaped magnetic circuit closing element.

In this method, and with such a punch, not only can the U-shaped core laminations and the T-shaped magnetic circuit closing elements be punched out in an essentially scrap-free manner using one tool, but the width-to-height ratio of the legs of the laminae can be selected freely, depending on the particular electromagnetic layout of the choke, or ballast. It is also possible for the sheets or laminae for chokes or ballasts to be stamped out essentially without waste such that they have a defined air gap in their magnetic path, which is located between the long leg of the T-shaped magnetic circuit closing elements and the opposed middle legs of the U-shaped core laminations. It is equally possible for cores having a low stray field and with reinforced outer legs to be produced essentially without waste, with the further advantage that cross-sectional reductions, occasioned in particular by manufacturing techniques, are absent from individual core legs according to the invention.

DRAWINGS

DETAILED DESCRIPTION

Figure 1:
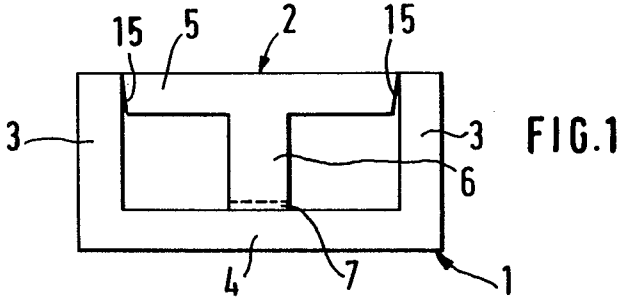
FIG. 1 is a side view of a core built up from U-shaped core laminations and T-shaped magnetic circuit closing elements.

The jacket core of a ballast or choke, or transformer, shown in FIG. 1 is built up from U-shaped core laminations 1 and T-shaped magnetic circuit closing elements 2. Each U-shaped core lamination 1 has two parallel outer legs 3, defined with straight faces, and one middle leg 4, extending at right angles to and connecting the two outer legs 3. The T-shaped magnetic circuit closing elements 2 are pressed in between the two outer legs 3 with their cross leg 5, from the middle of which a long leg 6 protrudes at a right angle. An air gap 7, optionally including a deformable, nonmagnetic air gap insert, may be formed on the end face of the long legs 6.

Figure 2:
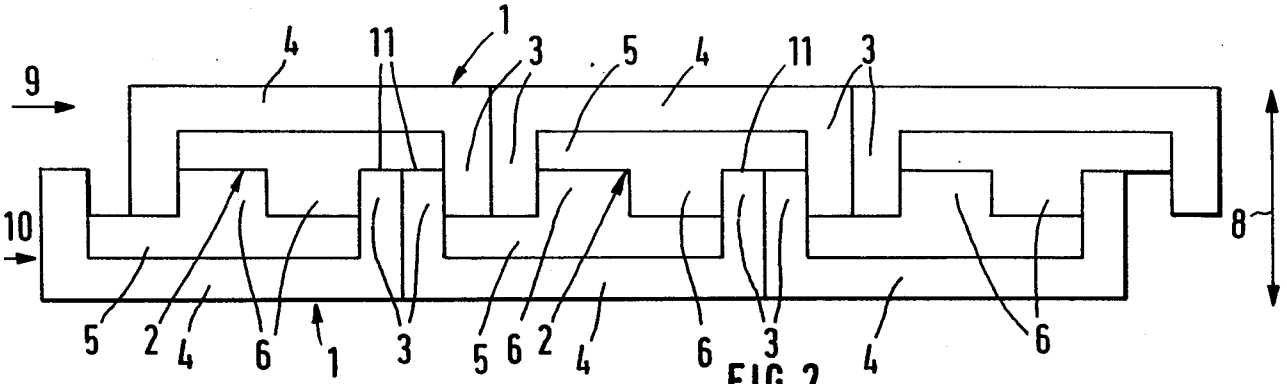
FIG. 2 shows how the U-shaped core laminations and the T-shaped magnetic circuit closing elements are arranged in the essentially scrap-free punching method according to the invention.

The U-shaped core laminations 1 and the T-shaped magnetic circuit closing elements 2 are punched out of a strip of sheet metal having the width 8 in the manner shown in FIG. 2, by a multistage operating, or progressive, die.

The arrangement is selected such that two rows 9, 10 of U-shaped core laminations 1 are located with their open ends interdigited facing one another, interfitting with respective pairs of outer legs 3 adjacent to one another. The U-shaped core laminations 1 adjacent to one another in the two rows 9, 10 are offset relative to one another in the longitudinal direction of the strip by an extent such that one pair of outer legs 3, 3 of one row is always laterally adjacent, toward the interior, to one pair of outer legs 3, 3 of the U-shaped core laminations 1 of the other row. All the U-shaped core laminations 1 are of the same size and dimensions as one another, and all the T-shaped magnetic circuit closing elements 2 are of the same size and dimensions as one another.

The T-shaped magnetic circuit closing elements 2 are punched out of the free spaces that are left between the end faces 11 of the outer pairs of legs 3, 3 and the middle legs 4, facing them and spaced apart from them, of the U-shaped core laminations. With their cross legs 5, the T-shaped magnetic circuit closing elements adjoin the middle legs 4 of the U-shaped core laminations, the length of one cross leg 5 corresponding to the distance between the parallel inner sides of the outer legs 3 of one U-shaped core lamination 1.

With their long legs 6, the T-shaped magnetic circuit closing elements 2 also, on one side, laterally adjoin one pair of outer legs 3, 3 of the respective opposed row of U-shaped core laminations 1 and, on the other side, laterally adjoin the long leg 6 of an adjacent, opposed T-shaped magnetic circuit closing element. Taken all in all, two outer legs 3 of two U-shaped core laminations 1 of one row and two long legs 6 of two magnetic circuit closing elements 2 located in mirror symmetry to one another are located between the two outer legs 3 of one U-shaped core lamination 1 of an opposed row.

The punching lines visible in FIG. 2 between the individual U-shaped core laminations 1 and the T-shaped magnetic circuit closing elements 2 show that all the sheets or laminae are punched out of the strip in the longitudinal direction thereof, essentially without waste, or scrap. The outer legs 3 of the U-shaped core laminations 1 may be selected to be of arbitrary width, as is also the case with the height of the U- and T-shaped laminae 1, 2; that is, the structural height can be adapted to given requirements without imposing any restrictions, simply by the appropriate selection of the width of the band of sheet metal.

Figure 3:
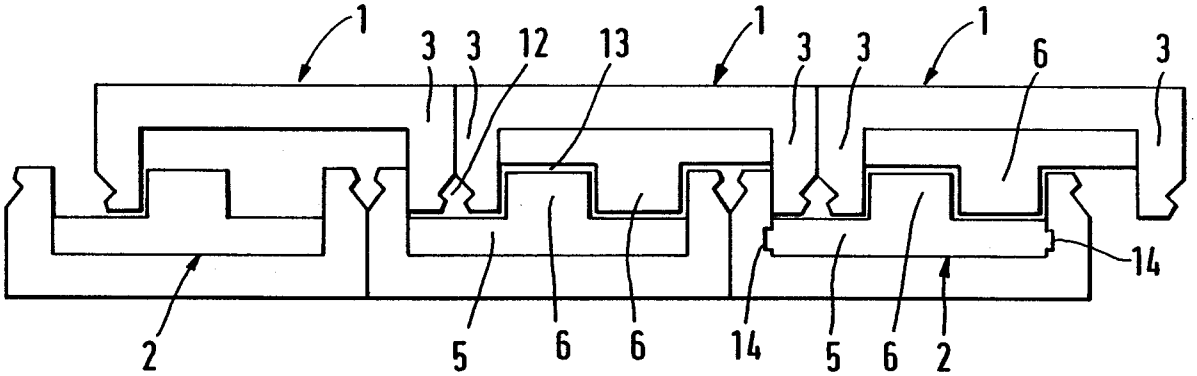
FIG. 3, in a view similar to FIG. 2, shows a modified form of the arrangement according to FIG. 2.

The arrangement according to FIG. 3 essentially is equivalent to that of FIG. 2. The only difference is that profiled recesses 12 are punched out of the outer ends of the outer legs 3 of the U-shaped core laminations 1; these recesses serve to attach a U-shaped clamping rail, which presses the outer legs 3 together, in the finished ballast, or choke. The long legs 6 of the T-shaped magnetic circuit closing elements 2 are also shortened at 13 by a web of scrap that remains between them; with this, ballasts or chokes having an air gap 7 as in FIG. 1 can be made.

In order to enable pressing the T-shaped magnetic circuit closing elements 2 in between the outer legs 3 of the U-shaped core laminations 1 with a bias, it is readily possible for these elements 2 to be punched out with a somewhat greater length than one equal to the distance between the insides of the outer legs 3 of a U-shaped core lamination 1. To this end, it may be appropriate to punch the cross legs 5 such that small rectangular extensions 14 are provided on their end face, having a length of approximately 0.02–0.03 mm and having a height less than the height of the cross leg 5, which otherwise corresponds in length to the distance between the insides of the outer legs 3 of one U-shaped core lamination 1. Additionally, the cross legs 5 of the T-shaped magnetic circuit closing elements 2 may also be punched out with a slight obliquity 15 at the end (FIG. 1), extending toward the middle leg 6; taken together with the maximum length of the cross leg 5, which somewhat exceeds the distance between the insides of the outer legs 3 of one U-shaped core lamination 1, this obliquity assures that the cross legs 5 will be fitted in with a bias between the outer legs 3. The difference between the maximum and minimum length at the outer and inner edge of one cross leg, on each end, is on the order of magnitude of 0.02 to 0.03 mm.

The strip-like punching pattern shown in FIG. 2 may be directly equivalent to the width of the strip of sheet metal from which it is punched out; for reasons of economy, however, it may also be suitable for a plurality of such striplike like punching patterns to be arranged adjacent one another on one width of a sheet-metal strip, or in other words to punch the elements essentially without waste from a correspondingly wider strip of sheet metal.

During the punching process, all the sheet-metal parts or laminae are punched out by the die and essentially no unattached parts are produced that would have to be mechanically removed from the tool. This is the prerequisite for high-speed punching and automatic formation of the sheets into lamination packets within the tool and the press.

Profiled recesses arranged for receiving a clamping rail that clamps the outer legs together can be punched out in the outer legs of the U-shaped core laminations, these recesses having a substantially triangular cross section. These recesses do not cause any reduction of the cross section of other core lamination parts, and the shape of the recesses can be selected arbitrarily to suit a given purpose.

It is advantageous for the cross legs of the T-shaped magnetic circuit closing elements 2 to be somewhat longer than the distance between the parallel insides of the U-shaped core laminations 1. In this manner, when the choke or ballast is assembled and the T-shaped magnetic circuit closing element 2 is inserted, the outer legs 3 of the U-shaped core lamination 1 can be pressed outward somewhat, so that the entire structure is biased and gains greater stability. To this end, the arrangement may be selected to be such that the T-shaped magnetic circuit closing elements 2 have punched-out extensions on the end faces of their cross leg 5, the extensions being spaced apart at the ends by a distance somewhat greater than the distance between the parallel insides of the outer legs 3 of the U-shaped core laminations 1, and the height of the extensions being less than the height of the cross legs 5, which otherwise correspond in length to the distance between the insides of the outer legs 3.

Finally, the cross legs 5 of the T-shaped magnetic circuit closing element 2 may also be punched out such that they slope at the ends toward the middle leg 6; this is another way to provide biasing of the junctions when the T-shaped magnetic circuit closing element is fitted into the U-shaped core lamination.

We claim:

1. A method of making, from a flat strip of electrical sheet steel, core laminations for an electrical inductive element, such as a ballast, choke, or transformer, in which the core laminations include:

essentially U-shaped integral laminae having two parallel projecting side, or outer, legs (3) and a connecting or middle leg (4) therebetween, and essentially T-shaped integral laminae having a projecting center leg (6) and a cross leg (5), comprising, in accordance with the invention, the combination of the steps of punching the essentially U-shaped laminae (1) in interdigited positions in which the respective outer edges of the connecting legs (4) define opposite sides of the punching strip; and defining for the essentially T-shaped laminae, positions in which a first essentially T-shaped lamina has its center leg (6) projecting - with respect to the width (8) of the strip - in a direction opposite to the direction of projection of the side leg (3) of a first U-shaped lamina (1), and punching the first essentially T-shaped lamina in a position in which (a) one side of the center leg (6) fits against an inner edge of the side leg (3) of said first essentially U-shaped lamina (1), and (b) the other side of the center leg (6) fits against a side of a center leg of a neighboring essentially T-shaped lamina, and in which the neighboring T-shaped lamina has its center leg projecting in a direction opposite the direction of projection of the center leg of the first lamina.

2. Method according to claim 1 including the step of punching-out notches of predetermined cross section at the outer edges of the U-shaped laminae (1) to provide for reception of clamping elements.

3. Method according to claim 1 wherein the step of punching said first essentially T-shaped laminae comprises defining the cross leg (5) of the essentially T-shaped lamina to be slightly longer than the distance between parallel inner sides of the projecting legs (3) of the essentially U-shaped laminae (1) in a region adjacent the connecting leg (4).

4. Method according to claim 3 wherein said punching step further comprises defining the cross legs (5) of the essentially T-shaped laminae to include projecting extensions (14) at the end sides of said cross legs (5), which have a limiting distance between each other slightly greater than the distance between the parallel inner sides of the projecting side legs (3) of the essentially U-shaped laminae, and having a height which is smaller than the length of the projecting distance and the length of the inside of the projecting legs (3) of the essentially U-shaped laminae.

5. A punch arrangement for punching, from a flat strip of electrical sheet steel, core laminations for an electrical inductive element, such as a ballast, choke, or transformer, in which the core laminations include essentially U-shaped integral laminae having two parallel projecting side, or outer, legs (3) and a connecting or middle leg (4) therebetween, and essentially T-shaped integral laminae having a projecting center leg (6) and a cross leg (5), comprising, in accordance with the invention, the combination of a first punch die element having punching, or cutting, edges for punching the essentially U-shaped laminae (1) in interdigited positions in which the respective outer edges of the connecting legs (4) define opposite sides of the punching strip; and a second punch die element having punching or cutting edges for punching first essentially T-shaped laminae in a position in which (a) one side of the center leg (6) fits against an inner edge of the side leg (3) of said first essentially U-shaped lamina (1), and (b) the other side of the center leg (6) fits against a side of a center leg of a neighboring essentially T-shaped lamina, and in which the neighboring T-shaped lamina has its center leg projecting in a direction opposite the direction of projection of the center leg of the first lamina, to thereby punch the essentially T-shaped lamina in positions in which a first essentially T-shaped lamina has its center leg (6) projecting—with respect to the width (8) of the strip—in a direction opposite to the direction of projection of the side leg (3) of a first U-shaped lamina (1).

6. Arrangement according to claim 5 including third and fourth die elements, respectively forming the mirror image of the first and second punch die elements for punching, in interdigited punching pattern, two U-shaped, and 2 T-shaped laminae.

* * * * *

UNITED STATES PATENT AND TRADEMARK OFFICE

CERTIFICATE OF CORRECTION

PATENT NO. : 4,711,019

DATED : Dec. 8, 1987

INVENTOR(S) : ALBECK et al

It is certified that error appears in the above-identified patent and that said Letters Patent is hereby corrected as shown below:

Title page, right-hand column, ABSTRACT,
line 16, delete "tem" insert -- them --
line 21, delete "outer" insert -- other --
line 23, delete "legs" insert -- leg --

Signed and Sealed this

Twenty-second Day of August, 1989

*Attest:*

DONALD J. QUIGG

*Attesting Officer*

*Commissioner of Patents and Trademarks*